US010390679B2

(12) United States Patent
Kim et al.

(10) Patent No.: US 10,390,679 B2
(45) Date of Patent: Aug. 27, 2019

(54) DISHWASHER

(71) Applicant: LG ELECTRONICS INC., Seoul (KR)

(72) Inventors: Minchul Kim, Seoul (KR); Taehwan Cho, Seoul (KR); Sangsoo Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 132 days.

(21) Appl. No.: 15/273,934

(22) Filed: Sep. 23, 2016

(65) Prior Publication Data

US 2017/0086641 A1 Mar. 30, 2017

(30) Foreign Application Priority Data

Sep. 24, 2015 (KR) ..... 10-2015-0135609
Jan. 5, 2016 (KR) ..... 10-2016-0000987

(51) Int. Cl.
*A47L 15/42* (2006.01)

(52) U.S. Cl.
CPC ..... *A47L 15/4206* (2013.01); *A47L 15/4204* (2013.01); *A47L 15/428* (2013.01); *A47L 15/4246* (2013.01); *A47L 15/4251* (2013.01)

(58) Field of Classification Search
CPC ..... A47L 15/4206; A47L 15/4251; A47L 15/4204; A47L 15/4246; A47L 15/428
See application file for complete search history.

(56) References Cited

U.S. PATENT DOCUMENTS

2008/0237154 A1* 10/2008 Bragg ..... A47L 15/4204 210/808
2010/0224223 A1* 9/2010 Kehl ..... A47L 15/22 134/56 D
2011/0197933 A1* 8/2011 Yoon ..... A47L 15/4206 134/110

(Continued)

FOREIGN PATENT DOCUMENTS

CN 101103894 1/2008
CN 102341025 2/2012

(Continued)

OTHER PUBLICATIONS

NASA, "Why Metals Corrode", May 2018.*

(Continued)

*Primary Examiner* — Michael E Barr
*Assistant Examiner* — Benjamin L Osterhout
(74) *Attorney, Agent, or Firm* — Fish & Richardson P.C.

(57) ABSTRACT

A dishwasher that includes a tub including an interior area that is configured to receive objects and includes a bottom surface, wherein the bottom surface of the tub includes a first hole; a spray arm that is located in the tub and that is configured to spray water; a sump that is (i) coupled to the tub, (ii) located under the first hole, and (iii) configured to store water; a pump configured to provide water stored in the sump to the spray arm; a cover including a cover body that is coupled to the first hole, and a second hole penetrating the cover body; a supporter including a support body that is coupled to the second hole, and a third hole penetrating the support body; and a filter unit that is coupled to the third hole and that is configured to filter water provided to the sump is disclosed.

17 Claims, 3 Drawing Sheets

(56) References Cited

U.S. PATENT DOCUMENTS

2012/0017952 A1* 1/2012 Plum ..... A47L 15/4204 134/184
2012/0118336 A1* 5/2012 Welch ..... A47L 15/4206 134/110
2012/0186609 A1* 7/2012 Haltmayer ..... A47L 15/4202 134/104.1
2012/0291822 A1* 11/2012 Tuller ..... A47L 15/4208 134/110
2013/0032171 A1* 2/2013 Heidel ..... A47L 15/0049 134/10
2014/0007911 A1* 1/2014 Ross ..... A47L 15/4285 134/108
2014/0182625 A1* 7/2014 Lee ..... A47L 15/0047 134/18
2014/0238447 A1* 8/2014 Hofmann ..... A47L 15/4202 134/110
2014/0373876 A1* 12/2014 Feddema ..... A47L 15/4202 134/10
2015/0208895 A1* 7/2015 Lee ..... A47L 15/4206 134/104.4

FOREIGN PATENT DOCUMENTS

| | | |
|---|---|---|
| CN | 103547205 | 1/2014 |
| DE | 102011084119 | 4/2013 |
| EP | 2233058 | 9/2012 |
| EP | 2517611 | 10/2012 |

OTHER PUBLICATIONS

Extended European Search Report in European Application No. 16189668.3-1710, dated Jan. 19, 2017, 10 pages (with English translation).

'Youtube.com' [online]. "LG Dishwasher—Spray Arms," Aug. 2011, [retrieved on Mar. 17, 2017]. Retrieved from the Internet: URL<https://www.youtube.com/watch?v=ROWD_SBaT4s>, 2 pages.

Chinese Office Action in Chinese Application No. 201610822035.2, dated Jul. 9 2018, 16 pages.

* cited by examiner

DISHWASHER

CROSS-REFERENCE TO RELATED APPLICATIONS

This application claims the benefit of Korean Patent Applications No. 10-2015-0135609 filed on Sep. 24, 2015 and No. 10-2016-0000987 filed on Jan. 5, 2016, the contents of which are herein incorporated by reference in their entirety.

BACKGROUND OF THE DISCLOSURE

Field of the Disclosure

Embodiments of the present disclosure relate to a dishwasher.

Background of the Disclosure

Dishwashers are apparatuses configured to remove food scraps which remains on dishes or cooking tools (hereinafter, washing objects) using water and dishwashing detergent.

Typically, a dishwasher includes a tub defining a washing space, one or more racks provided in the tub and accommodating washing objects and an spray arm spraying washing water to the one or more racks The tub is the space exposed to the water sprayed from the spray arm and has to be made of a material which will not be corroded by the water.

Meanwhile, diverse mechanisms including the one or more racks, an spray arm and the like have to be provided in the rub and the tub made of metal which belongs to the incorrodible materials has a risk of damage in the process of assembling or dissembling such mechanisms.

If the metal tub is damaged by the mechanisms arranged therein, corrosion could occur from the damaged region. It is necessary that the dishwasher including the tub made of corrosion resistant metal should be provided with the means for preventing the corrosion of the tub.

SUMMARY OF THE DISCLOSURE

Accordingly, the present invention is provided to address the above-noted and other problems. An object of the present disclosure is to provide a dishwasher of which a tub accommodating washing objects may be managed in a sanitary way.

Another object of the present disclosure is to provide a dishwasher which is capable of minimizing scratch of the tub made of metal.

A further object of the present disclosure is to provide a dishwasher which is capable of minimizing thermal deformation of a cover for preventing scratch of a tub made of metal.

Embodiments of the present disclosure may provide a dishwasher comprising a tub including an interior area that is configured to receive objects and that includes a bottom surface, wherein the bottom surface of the tub has a first hardness and includes a first hole; a spray arm that is located in the tub and that is configured to spray water; a sump that is (i) coupled to the tub, (ii) located under the first hole, and (iii) configured to store water; a pump configured to provide water stored in the sump to the spray arm; a cover including a cover body that has a second hardness and that is coupled to the first hole, wherein the second hardness is less than the first hardness, and a second hole penetrating the cover body; a supporter including a support body that is coupled to the second hole, and a third hole penetrating the support body; and a filter unit that is coupled to the third hole and that is configured to filter water provided to the sump.

The bottom surface of the tub may include incorrodible metal or metal processed to become incorrodible.

The bottom surface of the tub may include stainless steel.

The filter unit may include a filter body having a third hardness, the third hardness being less than the first hardness and the filter body being detachably coupled to the third hole; a fourth hole configured to allow water to flow between the tub and the filter body; and a filter configured to (i) filter water provided to the filter body and (ii) discharge filtered water to the sump.

The cover may include a first seating portion that is configured to (i) hold the support body and (ii) position a top surface of the support body to be as high as or lower than a top surface of the cover body.

The tub may include a second seating portion that is configured to (i) hold the cover body and (ii) position a top surface of the cover body to be as high as or lower than the bottom surface of the tub.

The supporter may include an inclined portion configured to guide water to flow toward the third hole.

The cover may include an arm supporting portion that is coupled to the cover body and that is configured to support the spray arm.

The cover may include a fifth hole that penetrates the cover body and that is configured to allow water flow between the tub and the sump.

The cover may include a first cut-away portion that penetrates the cover body and that extends from an edge of the cover body toward a central area of the cover body.

The first cut-away portion may not be coupled to the second hole.

The first cut-away portion may not be coupled to the edge of the cover body.

The cover may include a second cut-away portion that couples the edge of the cover body to the second hole.

The cover may include a third seating portion configured to hold the support body, and the first cut-away portion may penetrate the third seating portion of the cover.

The supporter may include a sixth hole that penetrates the support body and that is configured to filter water provided to the sump, and the cover may include a seventh hole that penetrates the third seating portion and that is configured to guide water having passed through the sixth hole toward the sump.

The first cut-away portion may be configured to couple the edge of the cover body to the seventh hole.

The first cut-away portion may be configured to couple the second hole to the seventh hole.

The support body may have the first hardness.

The support body may include incorrodible metal or metal processed to become incorrodible.

The support body may include stainless steel.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings, which are given by illustration only, and thus are not limitative of the present invention, and wherein.

DESCRIPTION OF SPECIFIC EMBODIMENTS

Description will now be given in detail according to exemplary embodiments disclosed herein, with reference to the accompanying drawings.

Use of such terminology herein is merely intended to facilitate description of the specification, and the terminology itself is not intended to give any special meaning or function. In the present disclosure, that which is well-known to one of ordinary skill in the relevant art has generally been omitted for the sake of brevity.

The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

Figure 1:
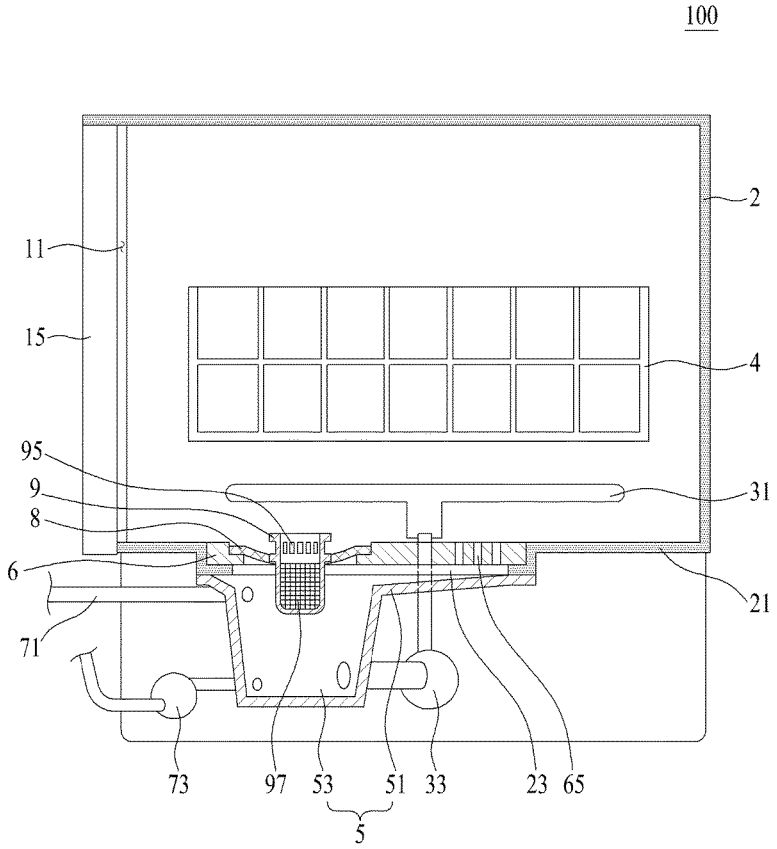
FIG. 1 is a block diagram illustrating a diagram illustrating one example of a dishwasher in accordance with the present disclosure.

As shown in FIG. 1, a dishwasher 100 includes a tub 2 defining an interior area in which washing objects are held; a rack 4 provided in the tub 2 and accommodating the washing objects; an spray arm 31 spraying water to the washing objects held in the rack; a sump 5 storing water; and a pump 33 supplying the water stored in the sump 5 to the spray arm 31.

The tub is in communication with the outside via an opening 11 and the opening 11 is able to become open and closed by a door 15. The rack 4 may be taken out from the tub 2 via the opening 11.

The spray arm 31 may be arranged over or under the rack 4. The spray arm 31 illustrated in FIG. 1 is rotatably fixed to a bottom surface 21 of the tub and located under the rack 4.

The sump 5 is supplied water by a water supply unit 71 connected to a water supply source and the water stored in the sump 5 is drained outside the dishwasher 100 via a drainage unit 73. The sump 5 may include a storage 53 for storing water; and a sump body 51 fixing the storage 53 to the tub 2.

The sump body 51 is fixed to the bottom surface 21 of the tub and located outside the tub 2. In other words, the sump body 51 fixed to the bottom surface 21 of the tub may cover a communication hole 23 penetrating the bottom surface 21. The sump body 51 may include an inclined surface for guiding water toward the storage 53.

A cover 6 as a partitioning wall between the sump 5 from the tub 2 is provided in the communication hole 23 and a filter unit 9 filtering the water flowing to the sump 5 may be provided in the cover 6.

Meanwhile, the tub 2 is the space in which washing objects such as dishes are held and it is quite important to manage the tub 2 in a sanitary way. Especially, considering that the tub 2 is the space in contact with water, it is more important to manage the tub without rust.

Accordingly, the tub 2 may be made of stainless steel. The tub 2 may be made of various types of metal including anti-corrosive metal and anti-corrosion treated metal.

In case an overall inner surface of the tub including the bottom surface 21 of the tub 2 is made of stainless steel, the cover 6 is also made of the same material as the tub 2 in other words, in case the tub 2 is made of stainless steel, it is preferred that the cover 6 is also made of stainless steel in an aspect of the sanitary management.

However, if the tub 2 and the cover 6 are made of the same material, the hardness of the tub 2 is equal to the hardness of the cover 6 and there might be a risk of the scratch on the bottom surface 21 of the tub or a surface of the cover 6 when the cover is coupled to or decoupled from the communication hole 23. If the bottom surface 21 of the tub or the surface of the cover 6 is scratched, rust (corrosion of metal) might occur in the scratched region.

To solve such a disadvantage of corrosion, it is preferred that the cover 6 is made of a material having a lower hardness than the material of the tub 2. In other words, when the sub 2 is made of stainless steel (a material having a first hardness), the cover 6 may be made of a material having a second hardness which is lower than the first hardness. Examples of the material having the second hardness include synthetic resin such as plastic.

It is more advantageous as the area of the cover 6 having the second hardness is minimized. The cover 6 shown in FIG. 2 includes a cover penetrating hole 67 allowing the tub 2 to communicate with the sump 5 and a supporter 8 may be further provided in the cover penetrating hole 67. The supporter 8 is made of stainless steel (the material having the first hardness) and supports the filter unit 9.

In this instance, the cover 6 may include a cover body 61 detachable from the penetrating hole 23 formed in the bottom surface of the tub. The cover penetrating hole 67 may penetrate the cover body 61.

A seating portion (69, in other words, a first seating portion) supporting an edge portion of the supporter 8. The first seating portion 69 may be projected to the center of the cover penetrating hole from the edge of the cover penetrating hole 67. Specifically, the first seating portion 69 is projected toward the center of the cover penetrating hole 67 from the cover body 61 and form an edge portion of the cover penetrating hole 67.

Moreover, an arm supporting portion 63 rotatably supporting the spray arm 31 may be further provided in the cover body 61. In this instance, the pump 33 may move the water stored in the storage 53 to the arm supporting portion 63.

Figure 2:
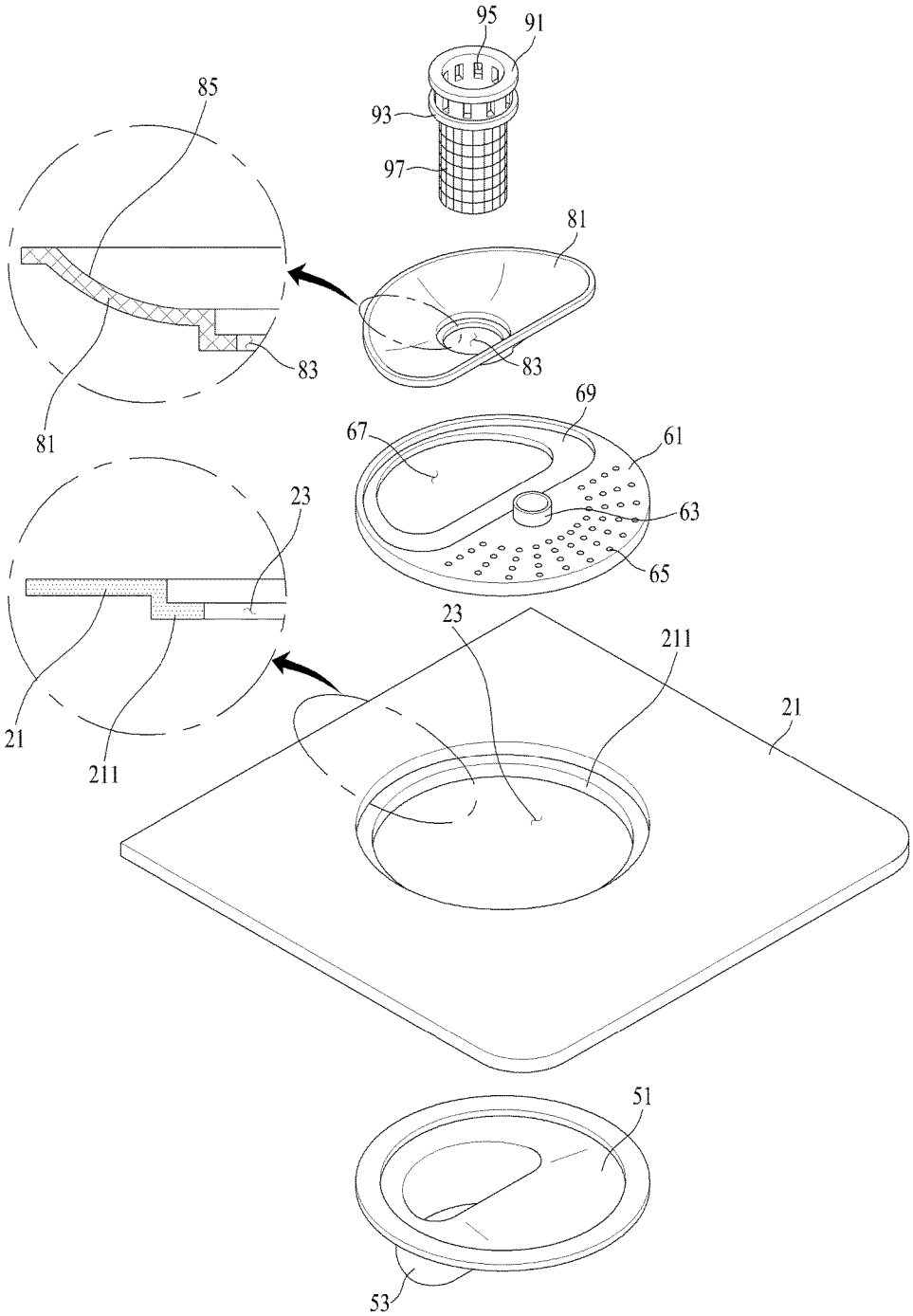
FIG. 2 is a diagram illustrating connection among a supporter, a cover, a tub and a sump.

A water collecting hole 65 may be further provided in the cover body 61 and collect and move the water inside the tub 2 to the sump 5. The water collecting hole 65 may penetrate the cover body 61 and FIG. 2 shows that the water collecting hole 65 is provided in the portion of the cover body 61 in which the water inside the tub 2 is supplied to the sump body 51.

To facilitate the flow of the water held in the bottom surface 21 of the tub toward the water collecting hole 65 and the filter unit 9, it is preferred that the top surface of the cover body 61 is equal to or lower than the bottom surface 21 of the tub.

For that, a seating portion (211, hereinafter, a second seating portion) supporting an edge portion of the cover body 61 may be provided in the communication hole 23. The second seating portion 211 may be extended toward the center of the communication hole from the edge of the communication hole 23.

In other words, the second seating portion 211 may be realized as the space having a surface formed lower than the tub bottom surface 21 by bending a surface of the tub bottom surface 21 toward the sump. The communication hole 23 may penetrate the second seating portion 211 so that the second seating portion 211 may be projected toward the center of the communication hole 23 from the bottom surface 21 of the tub and form the edge portion of the communication hole 23.

The supporter 8 includes a support body 81 made of the same material as the tub; and a body penetrating hole 83 penetrating the support body 81 and having the filter unit 9 coupled thereto.

The support body 81 is supported by the first seating portion 69 of the cover and the first seating portion 69 may support the support body 81 to locate the top surface of the support body 81 as high as or lower than the top surface of the cover body 61.

For that, the first seating portion 69 may be provided as the space having a surface formed lower than the surface of the cover body 61 by bending a surface of the cover body 61 toward the tub bottom surface 21.

The support body 81 may be integrally formed with the cover body 61 as one body but it is preferred that the support body 81 is detachably provided. To integrally form the support body 18 with the cover body 61, they have to be formed by injection mould and such the method for integrally forming the support body 81 with the cover body 61 requires higher cost than the method for detachably forming the support body 81 with respect to the cover body 61 as an independent part. Also, the method increases likelihood of assembly fault.

The body penetrating hole 83 may be provided in the portion where the tub 2 is in communication with the storage 53. An inclined portion 85 may be further provided in the support body 81 and guides water toward the body penetrating hole 83.

The filter unit 9 may be provided in any types capable of filtering the water flowing to the sump 5 from the tub 2. The filter unit 9 shown in FIG. 2 may include a filter body 91 detachable from the body penetrating hole 83; an inlet hole 95 sucking water to the filter body; and a filter 97 filtering and exhausting the water held in the filter body to the storage 53.

The filter body 91 may be provided in a cylindrical shape with an open top and made of a material having a lower hardness than the first hardness, to prevent the filter body 91 from scratching the support body 81 made of stainless steel. In other words, the filter body 91 may be made of a material having a third hardness which is lower than the first hardness. For example, the filter body 91 may be made of the same material (the material having the same hardness) used for the cover body 61. In this case, the filter body 91 may be made of a material having the first hardness.

The inlet hole 95 penetrates the filter body 91 and a plurality of inlet holes 95 may be provided along an upper circumferential surface of the filter body 91. In this instance, a body supporting portion 93 may be provided in the circumferential surface of the filter body 91 to locate the inlet holes 95 higher than the body penetrating hole 83. Accordingly, the inlet holes 95 may function as the means for drawing the foreign matters contained in the water to the filter body 91 as well as the means for sucking the water to the filter body 91 from the tub 2. Different from the embodiment mentioned above, the filter unit 9 may include only the filter 97 provided in the body penetrating hole 83.

As mentioned above, the present disclosure provides the dishwasher capable of managing the tub having most inner surface of the tub 2 is made of stainless steel in a sanitary way.

In the dishwasher in accordance with the present disclosure, the supporter 8 made of the material having the first hardness is supported by the cover 6 made of the material having the lower hardness than the first hardness, so that scratch on the supporter 8 or the bottom surface of the tub 2 may be prevented when the supporter 8 is coupled to the tub 2.

Figure 3:
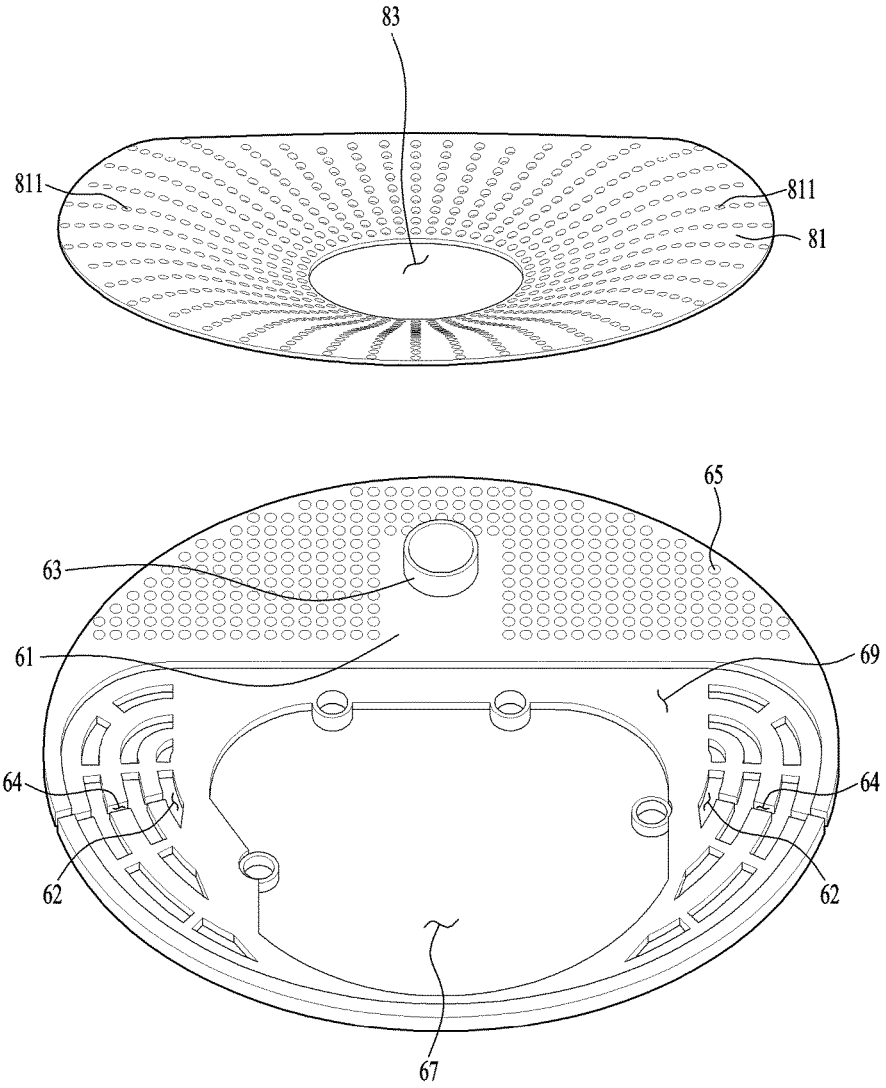
FIG. 3 is a diagram illustrating one embodiment of the cover and supporter provided in one example of the dishwasher in accordance with the present disclosure.

FIG. 3 illustrates another embodiment of the cover 6 and the supporter 8 mentioned above. The illustrated embodiment of the supporter 8 may include a filtering hole 811.

The filtering hole 811 includes a plurality of holes penetrating the support body 81 and filters the water flowing toward the filter unit 9 from the bottom surface 21 of the tub.

Accordingly, the water sprayed to the internal space of the tub via the spray arm 31 may be filtered by the filter unit 9 and flow to the sump 5. As one alternative example, the water may be filtered by the filtering hole 811 provided in the supporter 8 and the water collecting hole 65 provided in the cover 6 and then flow to the sump.

The cover 6 of this embodiment may further include a seating portion penetrating hole 62 penetrating the first seating hole 69; and a cut-away portion 64 for preventing thermal deformation of the first seating portion 69.

The seating portion penetrating hole 62 may function as the means facilitating the flow of the water toward the sump 5 after passing through the filtering hole 811.

The dishwasher 100 of the present disclosure may further include a heater heating the water stored in the sump 5 to enhance washing efficiency. In case the spray arm 31 injects the water heated by the heater toward the washing objects, the tub 3, the cover 6 and the supporter 8 might be thermally deformed.

The cover 6 provided in the dishwasher of the present disclosure may be made of the material different from the material used for the tub 3 and the supporter 8. Accordingly, the extent of the thermal deformation generated in the tub bottom surface 21 cannot help becoming different from that of the thermal deformation generated in the supporter 8.

If the thermal deformation is generated in the cover 6, the supporter 8 and the tub bottom surface 21 by the temperature inside the tub 2, the cover body 61 might become separated from the second seating portion 211 and the supporter 8 might become separated from the first seating portion 69.

The cut-away portion 64 may be the means for solve the disadvantage of the separation and the cut-away portion 64 may be provided as a hole or slit extended from the edge of the 61 to an internal space of the cover body 61.

In other words, the cut-away portion 64 may be provided in any shapes only if penetrating the cover body 61 and concavely recessed toward the internal space of the cover body 61 from the edge of the cover body 61.

In case the cut-away portion 64 mentioned above is provided in the cover body 61, the cover body 61 will become expanded within the space having the cut-away portion 64 while the thermal deformation is generated in the cover body 61. Accordingly, the cover body 61 may be prevented from becoming separated from the second seating portion by the expanded edge portion of the cover body 61 and the support body 81 may be also prevented from becoming separated from the first seating portion 69 by the thermal deformation (twisting) of the first seating portion 69.

Meanwhile, the cover penetrating hole 67 is formed to penetrate the first seating portion 69 and the area of the cover body 61 except the first seating portion 69 and the cover penetrating hole 67 may be larger than the area of the first seating portion 69.

If the area of the first seating portion 69 is smaller than the area of the cover body 61 except the first seating portion and the cover penetrating hole, the thermal deformation generated in the cover body 61 is intensively concentrated on the first seating portion having a relatively lower thermal resistance and thermal deformation is more likely to occur in the first seating portion 69 when a thermal energy is supplied to the cover 6.

It is preferred that the cut-away portion 64 is provided as the hole or slit extended toward the edge of the cover penetrating hole 67 from the edge of the cover body 61, passing through the first seating portion 69.

In case one cut-away portion 64 is provided in the cover 6, the cut-away portion 64 has to be provided not to be connected to the edge of the cover penetrating hole 67.

However, in case a plurality of cut-away portions 64 are provided in the cover 6, some (the first cut-away portion) may be extended toward the cover penetrating hole 67 from the edge of the cover body 61 not to be connected to the edge of the cover penetrating hole 67 and the others may be connected to the edge of the cover penetrating hole 67 and the edge of the cover body 61.

FIG. 3 shows that two cut-away portions 64 are provided in the cover body 61. It is characterized in FIG. 3 that each of the cut-away portions 64 are connected to the edge of the seating portion penetrating hole 62 and to the edge of the cover body 61. In this instance, the two cut-away portions 64 may be located in symmetry.

As one alternative example, the cut-away portion may be extended toward the edge of the cover body 61 from the edge of the cover penetrating hole 67. In other words, the cut-away portion 64 is extended from the edge of the cover penetrating hole 67 toward the edge of the cover body 61, not to be connected to the edge of the cover body 61.

Meanwhile, in case of being provided in the first seating portion, the cut-away portion 64 may connect the seating portion penetrating hole 62 penetrating the first seating portion 69 and the cover penetrating hole 67 with each other.

In case the plurality of the cut-away portions 64 are provided, some may be extended to the edge of the cover body 61 from the edge of the cover penetrating hole 67, not connected to the edge of the cover body 61. The others may connect the edge of the cover penetrating hole 67 and the edge of the cover body 61 with each other. In this instance, the cut-away portion connecting the seating portion penetrating hole 62 and the cover penetrating hole 67 has to be the first cut-away portion.

The foregoing embodiments are merely exemplary and are not to be considered as limiting the present disclosure. The present teachings can be readily applied to other types of methods and apparatuses. This description is intended to be illustrative, and not to limit the scope of the claims. The features, structures, methods, and other characteristics of the exemplary embodiments described herein may be combined in various ways to obtain additional and/or alternative exemplary embodiments.

What is claimed is:

1. A dishwasher comprising:

a tub including an interior area that is configured to receive objects and that includes a bottom surface, wherein the bottom surface of the tub has a first hardness and includes a first hole;

a spray arm that is located in the tub and that is configured to spray water;

a sump that is (i) coupled to the tub, (ii) located under the first hole, and (iii) configured to store water;

a pump configured to provide water stored in the sump to the spray arm;

a cover including:

a cover body that has a second hardness and that is coupled to the first hole, wherein the second hardness is less than the first hardness, a plurality of second holes penetrating the cover body, and a first cut-away portion that penetrates the cover body, that extends from an edge of the cover body in a direction toward a central area of the cover body, and that connects at least two of the plurality of second holes;

a supporter including:

a support body that is coupled to the second hole, and a third hole penetrating the support body; and a filter unit that is coupled to the third hole and that is configured to filter water provided to the sump, wherein the first cut-away portion is open toward the edge of the cover body to thereby allow the cover body to thermally expand.

2. The dishwasher of claim 1, wherein the bottom surface of the tub includes stainless steel.

3. The dishwasher of claim 1, wherein the filter unit includes:

a filter body having a third hardness, the third hardness being less than the first hardness and the filter body being detachably coupled to the third hole;

a fourth hole configured to allow water to flow between the tub and the filter body; and a filter configured to (i) filter water provided to the filter body and (ii) discharge filtered water to the sump.

4. The dishwasher of claim 3, wherein the cover includes:

a fifth hole that penetrates the cover body and that is configured to allow water flow between the tub and the sump.

5. The dishwasher of claim 4, wherein the cover includes:

a third seating portion configured to hold the support body, and wherein the supporter includes:

a sixth hole that penetrates the support body and that is configured to filter water provided to the sump, and wherein at least one of the plurality of second holes penetrates the third seating portion and is configured to guide water having passed through the sixth hole toward the sump.

6. The dishwasher of claim 5, wherein the first cut-away portion is configured to couple an edge of the cover body to the at least one of the plurality of second holes.

7. The dishwasher of claim 5, wherein the first cut-away portion is configured to couple a cover penetrating hole to the at least one of the second holes.

8. The dishwasher of claim 1, wherein the cover includes:

a first seating portion that is configured to (i) hold the support body and (ii) position a top surface of the support body to be as high as or lower than a top surface of the cover body.

9. The dishwasher of claim 8, wherein the tub includes:

a second seating portion that is configured to (i) hold the cover body and (ii) position a top surface of the cover body to be as high as or lower than the bottom surface of the tub.

10. The dishwasher of claim 1, wherein the supporter includes:

an inclined portion configured to guide water to flow toward the third hole.

11. The dishwasher of claim 1, wherein the cover includes:

an arm supporting portion that is coupled to the cover body and that is configured to support the spray arm.

12. The dishwasher of claim 1, wherein the first cut-away portion is not coupled to a cover penetrating hole.

13. The dishwasher of claim 1, wherein the first cut-away portion is not coupled to an edge of the cover body.

14. The dishwasher of claim 1, wherein the cover includes:

a second cut-away portion that couples an edge of the cover body to a cover penetrating hole.

15. The dishwasher of claim 9, wherein the cover includes:

a third seating portion configured to hold the support body, wherein the first cut-away portion penetrates the third seating portion of the cover.

16. The dishwasher of claim 1, wherein the support body has the first hardness.

17. The dishwasher of claim 1, wherein the support body includes stainless steel.

* * * * *